US006734636B2

(12) United States Patent
Sanford et al.

(10) Patent No.: US 6,734,636 B2
(45) Date of Patent: May 11, 2004

(54) OLED CURRENT DRIVE PIXEL CIRCUIT

(75) Inventors: James Lawrence Sanford, Hopewell Junction, NY (US); Frank Robert Libsch, White Plains, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/176,931

(22) Filed: Jun. 21, 2002

(65) Prior Publication Data

US 2002/0195968 A1 Dec. 26, 2002

Related U.S. Application Data

(60) Provisional application No. 60/300,216, filed on Jun. 22, 2001.

(51) Int. Cl.[7] ..... G09G 3/10

(52) U.S. Cl. ..... 315/169.3; 315/169.1; 345/76; 345/80; 345/82

(58) Field of Search ..... 315/169.1, 169.3; 345/46, 76, 77, 80, 82, 204; 257/59, 88

(56) References Cited

U.S. PATENT DOCUMENTS 6,023,259 A * 2/2000 Howard et al. ..... 345/76
6,580,657 B2 * 6/2003 Sanford et al. ..... 365/230.05
6,583,776 B2 * 6/2003 Yamazaki et al. ..... 345/77

OTHER PUBLICATIONS

Taysuya et al., "*24.4L: Late–News Paper: A 13.0–inch AM–Oled Display with Top Emitting Structure and Adaptive Current Mode Programmed Pixel Circuit (TAC)* ", p. 384–387.

Reiji Hattori and Jerzy Kanicki, "*Current–Source a–Si:H Thin–Film Transistor Circuit for Active–Matrix Organic Light–Emitting Displays*", IEEE Electronic Device Letter, 2000.

Hattori et al., "*Current–Writing Active–Matrix Circuit for Organic Light–Emitting Diode Display Using a–Si:H Thin–Film–Transistors*", IECE Trans. Electron., vol. 5, May 2000.

Technical Digest, "*International Electron Devices Meeting 1998*", Electron Device Society, Dec. 6–9, 1998.

Edward F. Kelley, "*Flat Panel display Technology and Display Metrology II*", SPIE–The International Society for Optical Engineering, vol. 4295, p. 133–146, Jan. 2001.

Johnson et al., "*Active Matrix PolyLED Displays*", p. 235–238.

* cited by examiner

*Primary Examiner*—Haissa Philogene
(74) *Attorney, Agent, or Firm*—Ohlandt, Greeley, Ruggiero & Perle, L.L.P.; Robert M. Trepp

(57) ABSTRACT

There is provided a method for driving an organic light emitting diode (OLED) pixel circuit. The method includes applying a first signal to a terminal of the OLED when setting a state of the pixel circuit, and applying a second signal to the terminal when viewing the state. There is also provided a driver for an OLED pixel circuit, where the driver employs this method.

17 Claims, 3 Drawing Sheets

OLED CURRENT DRIVE PIXEL CIRCUIT

CROSS REFERENCE TO RELATED APPLICATIONS

The present application is claiming priority of U.S. Provisional Patent Application Ser. No. 60/300,216, filed on Jun. 22, 2001.

BACKGROUND OF THE INVENTION

1. Field of the Invention

The present invention relates to an organic light emitting diode (OLED) pixel circuit, and more particularly, to a technique for driving the pixel circuit that minimizes stress effects of a TFT device that provides current to the OLED.

2. Description of the Prior Art

An organic light emitting diode (OLED) pixel may utilize any of a variety of organic materials that emit light when an electric current is applied thereto. An OLED display comprises a plurality of OLED pixels organized into an array.

One method to achieve a large size and large format OLED display is to use an active matrix thin film transistor (TFT) back plane. A head mount display and even a direct view display for a small mobile application may use polysilicon or crystalline silicon as a back plane. Due to investments in amorphous silicon flat panel technologies, there is interest in using amorphous silicon (a-Si) as opposed to polysilicon (p-Si) or crystalline (c-Si) silicon as a back plane technology to make a larger OLED display. Large area crystalline silicon back planes would not be as cost effective as amorphous or polysilicon.

Amorphous silicon does not have complimentary devices, as are available in polysilicon or crystalline silicon, for two reasons:

(1) only n-channel field effect transistors (NFETs) are available in amorphous silicon flat panel display (FPD) manufacturing due to fewer photolithographic steps, and hence lower costs, as compared to polysilicon and (2) p-channel field effect transistors (PFETs), although possible to make, exhibit substantially lower mobility or charge transport due to drift (approximately a factor of 5 to 10), and hence lower current drive, than n-channel field effect transistors (NFETs). NFETs have an average mobility approximately 0.5 to 1.0 $cm^2/V/sec$ in conventional manufacturing lines.

Due to a manner in which OLEDs are processed, it is not normally possible to drive OLEDs with an NFET configured current source. In conventional active matrix addressing, voltage signals are written into each pixel to control brightness of each pixel. The mobility and the stability characteristics of threshold voltage and mobility of amorphous silicon are suitable for driving twisted nematic liquid crystal, which is electrically similar to a small capacitive load, where a driving voltage is applied with a duty cycle in the range of 0.1% to 0.001%. However, for driving OLEDs requiring continuous current for operation, the amorphous silicon operating voltages are non-zero for a substantially larger percentage of the time, e.g., duty cycles of up to 100%. The higher voltages and continuous current severely stresses the amorphous silicon TFT. In particular, a gate to source voltage stress causes a threshold voltage to vary due to trapped charging and other effects such as creation of defect states and molecular bond breakage at a gate insulator-to-semiconductor interface and in a semiconductor layer of the TFT.

As the TFT's threshold voltage varies, current though the TFT will vary. As the current varies so does brightness of the OLED since light output of the OLED is proportional to current. A human observer can detect a pixel to pixel light output variation of as little as 1%. A higher level of 5% luminance variation is typically considered to be unacceptable.

FIG. 1 is a schematic of a prior art pixel circuit 100 used in a small a-Si backplane display test vehicle. Circuit 100 includes NFETs Q101 and Q102, a capacitor Cs 110 and an OLED 120.

NFET Q101 and Cs110 store a pixel voltage. A high voltage level on a gate line 125 turns NFET Q101 ON, thus providing a voltage from a data line 130 to Cs110. After a period of time, the gate voltage of NFET Q102 is the same as the voltage on data line 130, and voltage on gate line 125 is set low. NFET Q102 operates as a voltage follower to drive OLED 120. Current through OLED 120 is sourced from a supply voltage Vdd and returned to a supply voltage Vss. As OLED 120 is driven, a threshold voltage (Vt) of NFET Q102 changes with time t. The voltage across OLED 120 is $$Vdd-Vcs-Vgs(t)-Vss,$$

where:

Vcs=voltage across Cs110;

Vgs(t)=voltage gate-to-source of NFET Q102 as function of time t; and

Vss=negative supply voltage or OLED cathode voltage

The current through OLED 120 or NFET Q102 is proportional to $(Vgs-Vt)^2$ because NFET Q102 is biased in its saturation or constant current regime in which the drain to source voltage is equal to or greater than Vgs−Vt. As a result, voltage across OLED 120 and current through OLED 120 changes as the threshold voltage (Vt) of NFET Q102 changes. With different driving histories from pixel to pixel, pixel to pixel current and luminance vary. This is known as pixel differential aging. The threshold variation of NFET Q102, which requires continuous current for operation, is considered unacceptable for many applications. However, the stress of NFET Q102 operating in its saturation regime is less than if NFET Q102 was biased in its linear regime, the drain to source voltage <Vgs−Vt.

For use with a-Si TFT back planes, circuit 100 requires relatively low power and voltage since only one NFET, i.e., NFET 102, is connected from power supply Vdd to OLED 120, which is connected to supply voltage Vss. Since OLED 120 current passes through a single NFET, the voltage difference in power supplies Vdd and Vss is kept to a minimum, i.e., a maximum OLED 120 voltage and the drain to source voltage of NFET Q102 for operation just into the saturation regime.

A circuit that is similar to circuit 100 replaces NFET Q101 and NFET Q102 with PFET Q101 and PFET Q102, respectfully, which can be used with polysilicon or crystalline silicon technology. Instead of PFET Q102 operating as a voltage follower, PFET Q102 operates as a current source. PFET Q102's threshold voltage has an even greater impact on the current into OLED 120 since the current through OLED 120 is proportional to $(Vcs-Vt)^2$ where Vgs=Vcs. If crystalline silicon, which has a high transconductance, is used, then the Vgs voltage would have to be less than Vt in order to produce a current low enough to drive OLED 120 at brightness levels of the order $100/cd/m^2$ since pixel dimensions are usually very small. Threshold voltage variations in the subthreshold regime have an even greater impact on drain current variations because there is an order of magnitude current change for every 60 millivolt change in threshold voltage, or as dictated by a transistor drain current-gate voltage inverse sub-threshold slope, or approximately 60 mV/decade of current.

To minimize stress effects of a TFT device that provides OLED current, current driving is used to write a voltage stored in a pixel circuit. Sony Corporation, 7-35 Kitashinagawa 6-chome, Shinagawa-ku, Tokyo 141-0001, Japan has shown a polysilicon current mirror pixel in a 13" diagonal 800×600 color active matrix OLED (AMOLED) display. The Sony circuit was published by T. Sasaoka et al., "A 13.0-inch AM-OLED Display with top emitting structure and adaptive current mode programmed pixel circuit (TAC) ", in 2001 SID International Symposium Digest of Technical Papers, volume XXXII, p384–387. In the Sony circuit, data on its data line is in the form of current rather than voltage. However, the Sony circuit does not correct for threshold variation of an OLED driving transistor.

A four PFET transistor circuit for use with polysilicon was developed by Sarnoff Corporation, 201 Washington Road Princeton, N.J. 08543-5300, as described by R. M. A. Dawson et al., "The impact of the transient response of organic light emitting diodes on the design of active matrix OLED displays", in IEDM, p875–878, 1998. The Sarnoff circuit uses a data line current to directly set a current in a transistor that drives an OLED. However, the circuit requires polysilicon and uses two transistors in series between the OLED and a power supply and has a third input control signal that could be used for dark gray scale capability in high resolution displays. The third input control adds complication to the physical design pixel circuit and array design.

An alternative four polysilicon transistor arrangement was developed by Phillips Research, 5656 AA Eindhoven, the Netherlands, as described by T. van de Biggelaar et al, "Passive and active matrix addressed polymer light emitting diode displays" in Flat Panel Display Technology and Display Metrology II of the Proceedings of the SPIE, Vol. 4295 p134–146, 2001. This arrangement eliminates the third input control signal of the Sarnoff circuit, but also uses two transistors in series between the power supply and the OLED. The elimination of the third input does not allow its use in high-resolution displays having dark gray scale capability.

A similar circuit using four amorphous silicon NFET transistors using data line current was published by the University of Michigan, Ann Arbor, Mich. 48109, and more specifically by Yi He et al., "Current-source a-Si:H thin film transistor circuit for active-matrix organic light-emitting displays", in IEEE Electron Device Letters, vol.21, No.12, p590–592, 2000. One limitation of this circuit is that a second transistor is connected in series with an OLED current generating transistor to a power supply. This pixel circuit also would not be used in high-resolution displays having dark gray scale capability.

SUMMARY OF THE INVENTION

The present invention provides a method for driving an organic light emitting diode (OLED) pixel circuit. The method includes applying a first signal to a terminal of the OLED when setting a state of the pixel circuit, and applying a second signal to the terminal when viewing the state.

The present invention also provides a driver for an OLED pixel circuit. The driver includes a switch that directs a first signal to a terminal of the OLED when setting a state of the pixel circuit, and that directs a second signal to the terminal when viewing the state.

DESCRIPTION OF THE INVENTION

The present invention provides for a technique of driving a pixel circuit that minimizes stress effects of a TFT device that provides current to an OLED. Current driving is used to write a voltage stored in the pixel circuit. The circuit corrects for threshold variation of the TFT device. OLED current passes through a single transistor while allowing dark gray scale capability with high-resolution displays.

Figure 1:
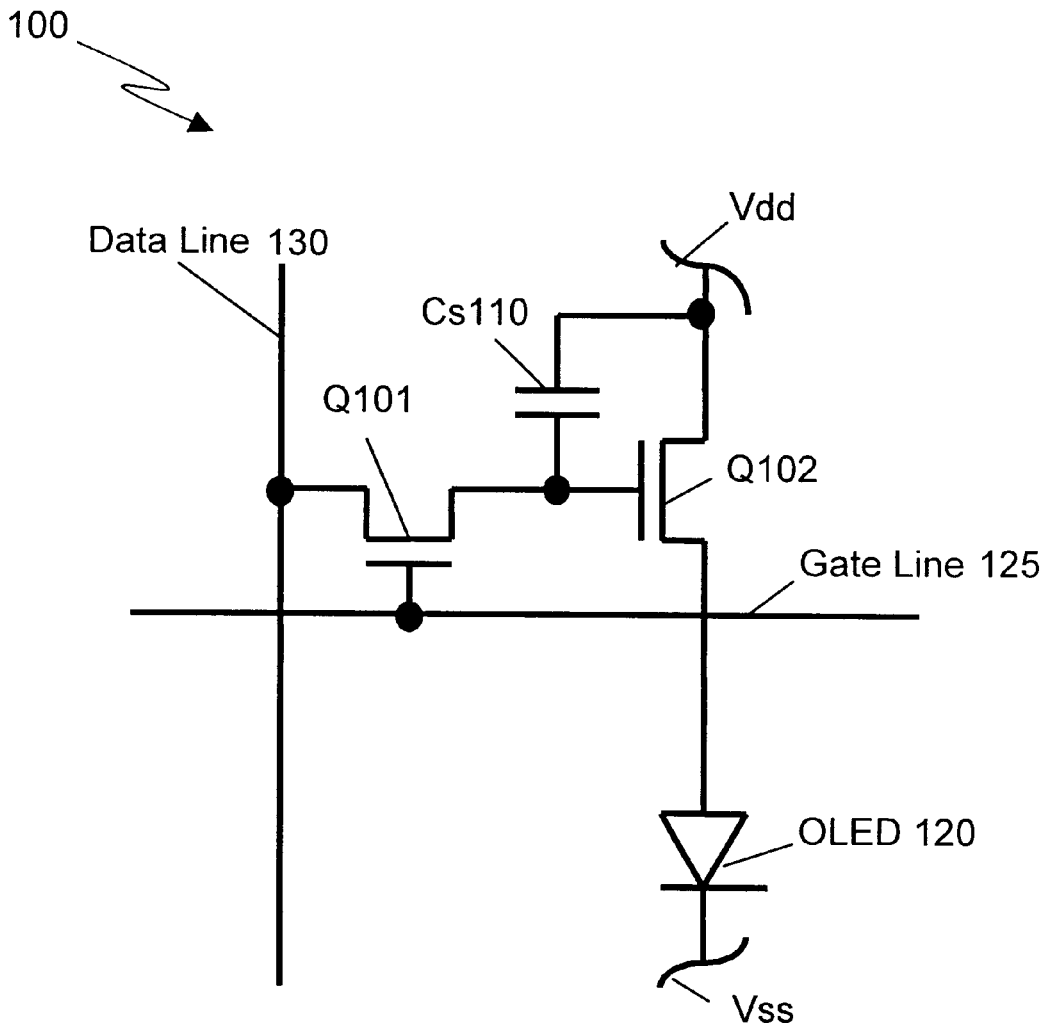
(PRIOR ART) FIG. 1
FIG. 1 is a schematic of a prior art pixel circuit.
Figure 2:
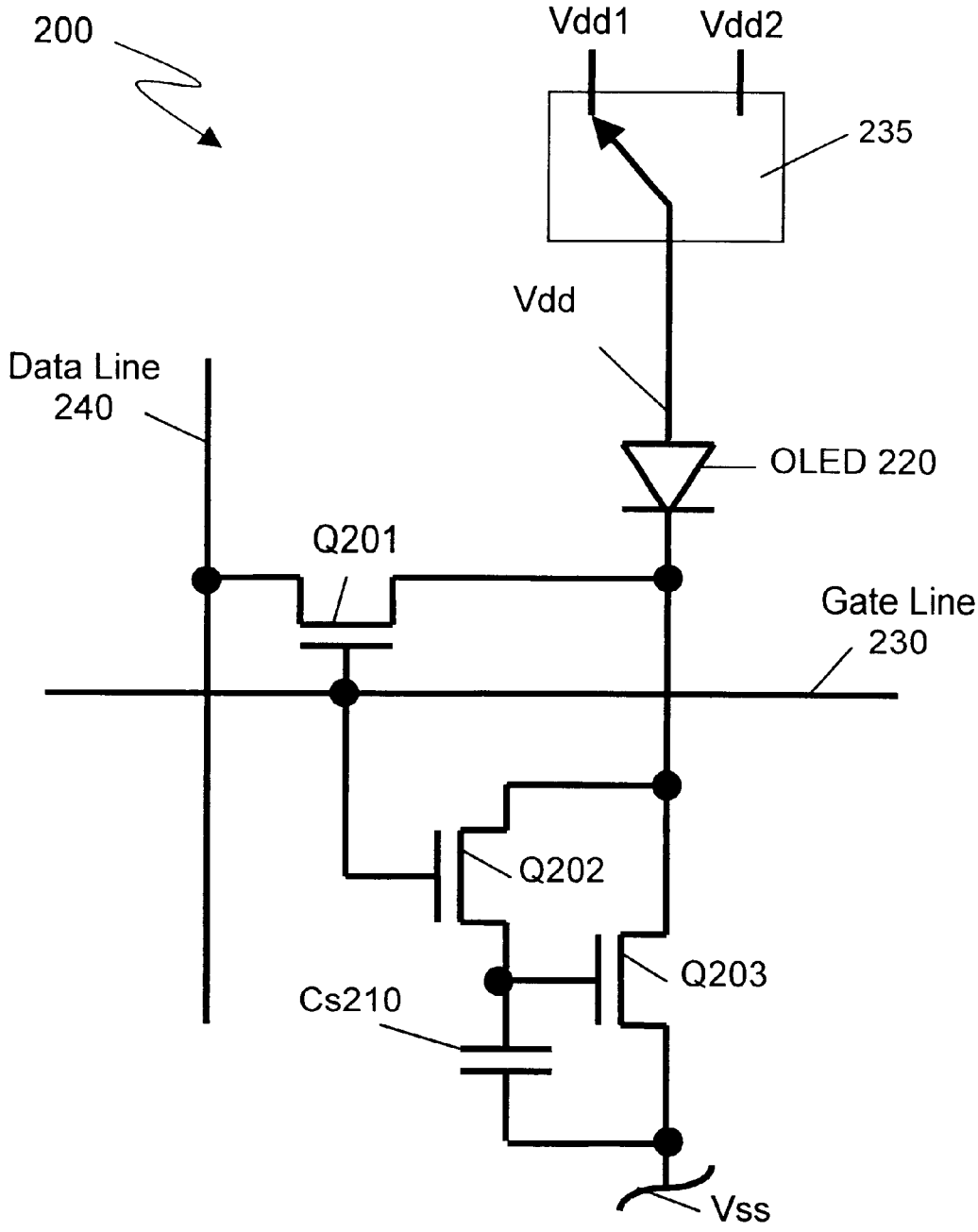
FIG. 2 is a schematic of a pixel circuit with a common anode being driven in accordance with the present invention.

FIG. 2 is a schematic of a pixel circuit 200 being driven in accordance with the present invention. Using data line current, a current through an OLED can accurately be established with a 3 NFET circuit that can accommodate threshold voltage or mobility variations. Circuit 200 includes NFETS Q201, Q202 and Q203, a data storage capacitor Cs210, an OLED 220 and a switch 235. Circuit 200 also includes a gate line 230, a data line 240, and supply voltages Vdd and Vss.

Switch 235 operates to apply or direct a first signal (Vdd1) to an anode terminal of OLED 220 when setting a state of pixel circuit 200, and to apply a second signal (Vdd2) to the anode terminal when viewing the state. "Setting a state" refers to writing data to pixel circuit 200, and "viewing the state" refers to observing the illumination of OLED 220. Through switch 235, Vdd is set low, i.e., to Vdd1, for writing data into circuit 200 and set high, i.e., to Vdd2, for presenting or viewing the data in circuit 200. Vss is held at a constant potential or voltage. Switch 235 can be any suitable switching device, but is preferably configured as an electrically controlled switch using transistors.

Data in the form of current into data line 240 is written into circuit 200 with a high voltage on gate line 230 turning on NFET Q201 and NFET Q202 while OLED 220 is off or is not emitting any luminance. OLED 220 is off when Vdd1 is <Vss+2V. OLED 220 is considered off when the voltage across OLED 220 is 2V or less and is substantially non-conductive. The application of Vdd1 to the anode of OLED 220 causes OLED 220 to be substantially non-conductive and may forward biased or reverse biased. When OLED 220 is off, the current through OLED 220 is very low so as to not effect the operation of circuit 200. The on state of NFET Q201 allows current or data to flow from data line 240 into the drains of NFET Q202 and NFET Q203. The on state of NFET Q202 connects drain and gate terminals of NFET Q203 together forcing the drain and gate voltages of NFET Q203 to be equal. This assures that NFET Q203 is in its saturation or constant current regime in which its drain to source voltage is equal to or greater than its gate to source voltage minus a threshold voltage. The on state of NFET Q202 charges or discharges data storage capacitor Cs210 until NFET Q202 no longer conducts any current and NFET Q203 drain to source current matches the data or current into data line 240. The voltage across data storage capacitor CS210 maintains the gate to source voltage of NFET Q203. This allows the drain to source current of NFET Q203, when operating in saturation with gate line 230 low, to be substantially the same as the current that was put into data line 240 when gate line 230 was high. With gate line 230 set low, the current into data line 240 can be set to any other value without modifying the drain to source current through NFET Q203.

A low voltage on gate line 230 turns off NFET Q201 and NFET Q202. The application of Vdd2 to the anode of OLED 220 allows OLED 220 to be on or to emit luminance. Through switch 235, Vdd is then brought high, to Vdd2, to a voltage greater than Vgs−Vt+Voled(max)+Vss to assure that drain to source voltage of NFET Q203 is greater than a pinch off voltage Vgs−Vt of NFET Q203. Voled(max) is the voltage of OLED 220 at maximum operating luminance. If there were no capacitance coupling effects due to switching gate line 230 low and switching Vdd to Vdd2, NFET Q203 would sink a current through OLED 220 matching the original current from data line 240. The current through OLED 220 is the drain to source current through NFET Q203.

As the gate line 230 is brought low, the gate to source capacitance of Q202 tends to reduce the voltage on storage capacitor Cs210. As Vdd is brought high, the capacitance of OLED 220 increases the voltage on the drain terminal of NFET Q203, where its drain to gate capacitance tends to increase the voltage of storage capacitor Cs210. Since the gate line 230 and supply voltage Vdd swing in opposite directions, it is possible to completely null out the combined coupling with careful design of channel widths and lengths of NFETs Q202 and Q203. Since the driving method of writing and viewing the data, and the combined capacitance voltage coupling onto storage capacitor Cs210 is the same for all pixels in the display, the combined capacitance voltage coupling onto storage capacitor Cs210 may also be accounted for or corrected by modifying a data or current into data line 240.

Circuit 200 incorporates a common anode arrangement for OLED 220 in which the anode of OLED 220 is common to other OLED anodes (not shown) by connection to supply voltage Vdd. Thus, switch 235 selectively directs Vdd1 or Vdd2 to the anode terminals of a plurality of pixel circuits. In general, fabrication for common anode OLED arrangements is more difficult than that for common cathode OLED arrangements.

For efficient electron and hole injection into OLED organic layers, it is essential to select anode and cathode materials with work functions or energy difference from vacuum energy to the Fermi energy levels that match the highest occupied molecular orbital (HOMO) and lowest unoccupied molecular orbital (LUMO) energies. Typical work functions are 4–5 eV for anodes and 2.7–5.3 eV for cathodes.

For higher efficiency, an OLED anode material must be a conductor of high work function to aid in an injection of holes efficiently into a HOMO of an adjacent organic layer, while an OLED cathode material must be a conductor of low work function to perform an injection of electrons efficiently into a LUMO of the adjacent organic layer. High work function metals are indium tin oxide ITO, indium zinc oxide IZO, nickel Ni, etc., and usually followed by an interface oxide treatment in an interface between the anode electrode and an organic hole transport layer. The interface oxide treatment ensures a highest work function barrier height possible for a given anode electrode, and can be accomplished by several means in the processing industry, such as oxygen O2 plasma treatment of one to several minutes.

In contrast, a OLED cathode material must be a conductor of low work function metals, such as lithium floride LiF, calcium Ca, magnesium gold MgAu, etc., and any oxygen-ation of the conductor electrode at the organic layer interface reduces electron injection efficiency. Although top or bottom emission structures are possible, the processing is much simplified if the anode material and organic layer interface oxide treatment are accomplished before the organic layers and cathode material are present. Processing is further simplified if one employs a common cathode since no patterning is needed in an active pixel area after the organic layers have been deposited.

Figure 3:
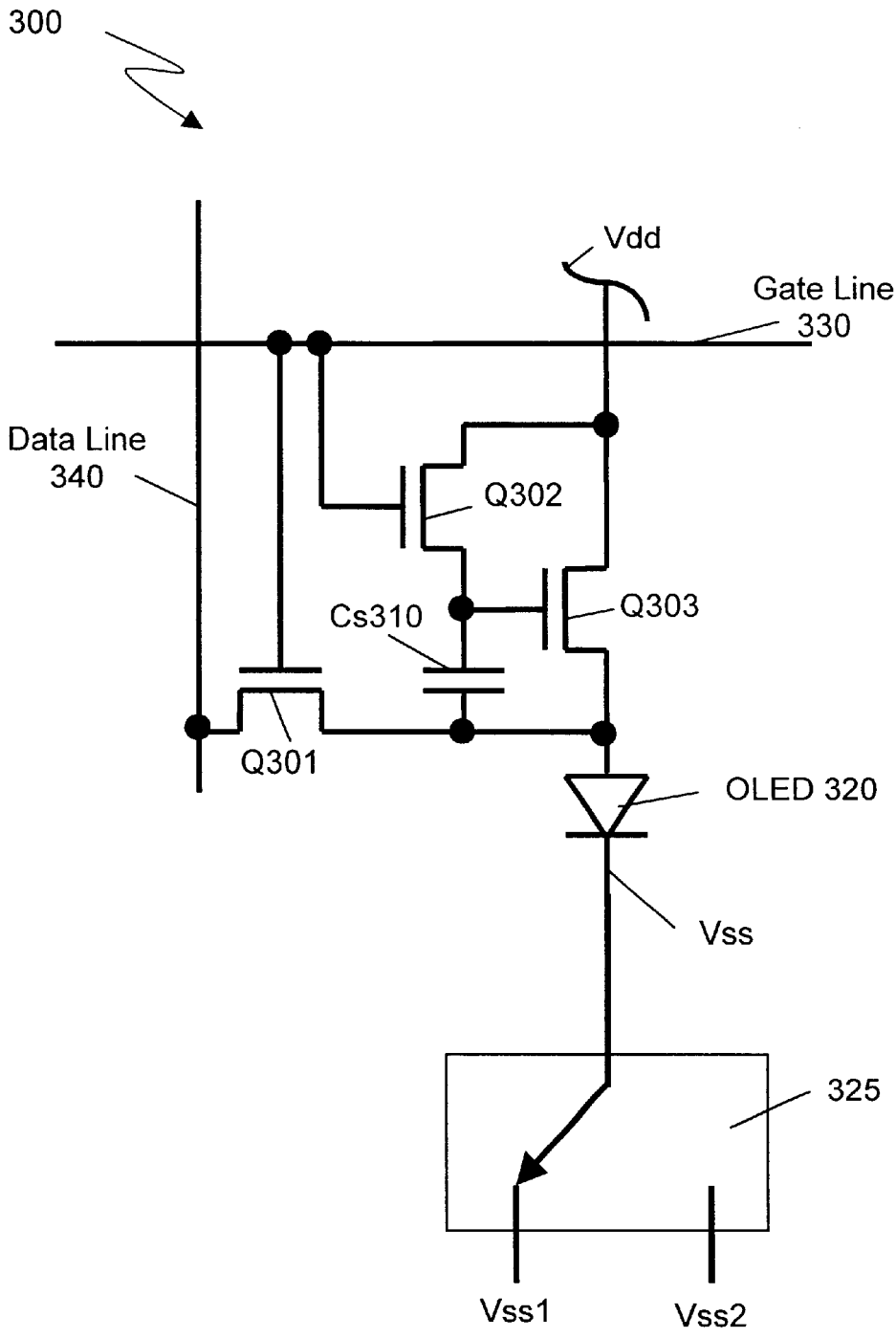
FIG. 3 is a schematic of a pixel circuit with a common cathode being driven in accordance with the present invention.

FIG. 3 is a schematic of a pixel circuit 300, in accordance with the present invention and incorporating a common cathode configuration. Using data line current, a current through an OLED can accurately be established with a 3-NFET circuit that can accommodate threshold voltage or mobility variations.

Circuit 300 incorporates a floating current source/sink circuit arrangement. Circuit 300 includes NFETs Q301, Q302 and Q303, a data storage capacitor Cs310, an OLED 320 and a switch 325. Circuit 300 also includes a gate line 330 and a data line 340.

Through switch 325, a supply voltage Vss is set high, i.e., to Vss2, for writing data into circuit 300 and set low, i.e., to Vss1, for viewing the data written into circuit 300. A positive supply voltage Vdd is held constant. Switch 335 can be any suitable switching device, but is preferably configured as an electrically controlled switch using transistors.

When the voltage on gate line 330 is brought high, NFETs Q301 and Q302 are turned on. Vss is set high, to Vss2, a voltage that is >Vdd−2V. The application of Vss2 to the cathode of OLED 320 causes OLED 320 to be off and to not emit any luminance. When OLED 320 is off, the current through OLED 320 is very low so as to not effect operation of circuit 300. Data in the form of current is sunk or pulled out data line 340. NFET Q302 connects the gate of NFET Q303 to Vdd, assuring that NFET Q303 operates in a saturation regime when current ceases to flow through data storage capacitor Cs310 and only through NFET Q303. NFET Q303 operates as a current source, matching the current being sunk out of data line 340.

The application of Vss1, a voltage <Vdd−Vgs+Vt−Voled (max), where Voled(max) is the voltage across OLED 320 when emitting at maximum luminance, to the cathode of OLED 320 allows OLED 320 to be turned on or emit luminance. When the voltage of gate line 330 is brought low and Vss is set low, to Vss1, to assure NFET Q303 is in the saturated regime (Vdd−Vgs+Vt−Voled), the drain to source current of NFET Q303 will flow through OLED 320.

As gate line 330 is set low, gate to source capacitance of NFET Q302 tends to reduce the voltage on data storage capacitor Cs310. As gate line 330 is set low, gate to drain capacitance of NFET Q301 tends to increase the voltage on data storage capacitor Cs310. As Vss is set low, to Vss1, the capacitance of OLED 320 and the gate to drain capacitance of NFET Q303 tends to increase the voltage on data storage capacitor Cs310. With careful design of the channel lengths and widths of NFETs Q301, Q302 and Q303, it is possible to null out the voltage coupling on data storage capacitor Cs310. Since the driving method of writing and presenting data, and the combined capacitive voltage coupling onto storage capacitor Cs310 is the same for all pixels in the display, the combined capacitive voltage coupling onto storage capacitor 310 may also be accounted for or corrected by modifying a data or current pulled out of data line 340. Data storage capacitor Cs310 and NFET Q303 can be regarded as a floating current source without a supply voltage for referencing.

Another aspect of the present invention is that it can effectively reduce the viewing to allow a pixel to be written with a high writing current. It is desirable for such circuits to handle 8-bit gray scale operation. To achieve this, the OLED current would need to vary by at least two orders of magnitude.

Time required to charge or discharge capacitance of a data line with lower gray level currents for proper writing of current into a pixel circuit may exceed a gate line on-time in a high resolution display. One solution is to use higher data line current and to reduce viewing time of the pixel circuit's data. The viewing time can be adjusted by adjusting the time during which supply voltage Vdd in FIG. 2 is set high to Vdd2 and by adjusting the time during which supply voltage Vss in FIG. 3 is set low to Vss1. It is in this manner that the forth transistor and the third pixel circuit input signal, as shown in the prior art, are eliminated. This helps to reduce power supply voltages and power dissipation since the voltage drop across the forth transistor as used in the prior art has been eliminated.

In a display having a plurality of pixels, the power supply connection to the OLED, Vdd in circuit 200 and Vss in circuit 300, is the same connection to all pixels in the display. However, it may be useful to separate the Vdd or Vss connection into multiple connections each having a separate switch, switch 235 in circuit 200 and switch 325 in circuit 300, and each having separate view timing. For example, view times can be staggered in time to spread out to reduce the peak or maximum Vdd and Vss currents. The lower current would reduce the voltage drops in Vdd or Vss voltage distribution.

Electrical stress due to normal operating voltages on NFETs Q201 and Q202 in circuit 200 and NFETs Q301 and Q302 in circuit 300 is similar to that in active matrix liquid crystal displays. These NFETs function as electrical switches with a very low duty factor. The present invention minimizes stress effects of NFETs, Q203 in circuit 200 and Q303 in circuit 300, that provide current to an OLED as compared to prior art circuits. In the present invention, when writing data, the Vdd1 voltage in circuit 200 and Vss2 voltage in circuit 300 can be set to not only turn off the OLED but to change the drain to source and gate to drain voltage polarity on NFETs Q203 in circuit 200, and Q303 in circuit 300. The polarity reversal aids in removing trapped charge in the gate to drain oxide and drain to source channel regions. It should be noted that it is also possible to reverse the gate to source voltage polarity of NFETs Q203 in circuit 200, and Q303 in circuit 300. When writing, a voltage that is less than Vss in circuit 200 on data line 240, or that is greater than Vdd in circuit 300 on data line 340, can be applied. The writing of a voltage on the data line to reverse gate to source voltages of NFETs Q203 in circuit 200, and Q303 in circuit 300 would occur after viewing the previous pixel state and before writing the next state in the pixel.

Circuits 200 and 300 may be implemented in amorphous silicon, polysilicon or crystalline silicon. Circuit 200 and circuit 300 can be readily modified for use with PMOS devices.

It should be understood that various alternatives and modifications could be devised by those skilled in the art. The present invention is intended to embrace all such alternatives, modifications and variances that fall within the scope of the appended claims.

What is claimed is:

1. A method for driving an organic light emitting diode (OLED) pixel circuit comprising:

applying a first signal to a terminal of said OLED when setting a state of said pixel circuit; and applying a second signal to said terminal when viewing said state.

2. The method of claim 1, wherein said first signal causes said OLED to be off.

3. The method of claim 1, wherein said first signal causes said OLED to be reverse biased.

4. The method of claim 1, wherein said second signal allows said OLED to be forward biased.

5. The method of claim 1, wherein said state is set by a current drive.

6. The method of claim 1, further comprising altering a duty factor of said first signal with respect to said second signal.

7. The method of claim 1, wherein said pixel circuit is one of a plurality of pixel circuits, and wherein said method further comprises applying said first signal and said second signal to a terminal of each of said plurality of pixel circuits.

8. A driver for an organic light emitting diode (OLED) pixel circuit comprising:

a switch, wherein said switch directs a first signal to a terminal of said OLED when setting a state of said pixel circuit; and wherein said switch directs a second signal to said terminal when viewing said state.

9. The driver of claim 8, wherein said first signal causes said OLED to be off.

10. The driver of claim 8, wherein said first signal causes said OLED to be reverse biased.

11. The driver of claim 8, wherein said second signal allows said OLED to be forward biased.

12. The driver of claim 8, wherein said state is set by a current drive.

13. The driver of claim 8, wherein said switch is controlled to alter a duty factor of said first signal with respect to said second signal.

14. The driver of claim 8, wherein said pixel circuit is configured of a material selected from the group consisting of amorphous silicon, polysilicon and crystalline silicon.

15. The driver of claim 8, wherein said pixel circuit provides current through said OLED through a single transistor.

16. The driver of claim 15, wherein said transistor operates in saturation when said switch directs said second signal to said terminal.

17. The driver of claim 8, wherein said pixel circuit is one of a plurality of pixel circuits, and wherein said switch directs said first signal and said second signal to a terminal of each of said plurality of pixel circuits.

* * * * *